US007004354B2

(12) United States Patent
Harper

(10) Patent No.: US 7,004,354 B2
(45) Date of Patent: Feb. 28, 2006

(54) HAND SANITIZING PACKET AND METHODS

(76) Inventor: William Anthony Harper, 16541 Redmond, PMB 140, Redmond, WA (US) 98052

( * ) Notice: Subject to any disclaimer, the term of this patent is extended or adjusted under 35 U.S.C. 154(b) by 190 days.

(21) Appl. No.: 10/602,448

(22) Filed: Jun. 24, 2003

(65) Prior Publication Data

US 2005/0006404 A1 Jan. 13, 2005

(51) Int. Cl.
*B65D 35/022* (2006.01)

(52) U.S. Cl. ..... 222/94; 222/212

(58) Field of Classification Search ..... 222/94, 222/107, 212
See application file for complete search history.

(56) References Cited

U.S. PATENT DOCUMENTS

| | | | | |
|---|---|---|---|---|
| 2,707,581 | A | 5/1955 | Kaplan | |
| 2,976,988 | A * | 3/1961 | Schneider | 206/445 |
| 3,184,121 | A | 5/1965 | Volckening | |
| 3,278,085 | A | 10/1966 | Brown | |
| 3,635,376 | A | 1/1972 | Hellstrom | |
| 3,670,927 | A * | 6/1972 | Hubbard | 222/107 |
| 3,913,789 | A | 10/1975 | Miller | |
| 4,328,912 | A | 5/1982 | Haggar | |
| 4,491,245 | A | 1/1985 | Jamison | |
| 4,759,472 | A | 7/1988 | Strenger | |
| 4,872,556 | A | 10/1989 | Farmer | |
| 4,890,744 | A | 1/1990 | Lane | |
| 5,018,646 | A | 5/1991 | Billman | |
| 5,131,760 | A | 7/1992 | Farmer | |
| 5,261,881 | A * | 11/1993 | Riner | 604/110 |
| 5,529,224 | A | 6/1996 | Chan et al. | |
| D375,676 | S * | 11/1996 | Davis et al. | D9/707 |
| 5,839,609 | A | 11/1998 | Zakensberg | |
| 6,228,375 | B1 | 5/2001 | Kocher | |
| 6,244,468 | B1 * | 6/2001 | Farmer et al. | 222/107 |
| 6,360,916 | B1 | 3/2002 | Sokolsky | |
| 6,379,069 | B1 | 4/2002 | May | |

OTHER PUBLICATIONS

Hooper, Judith (1999), A New Germ Theory; *Atlantic Monthly;* Feb. 1999; http://www.the atlantic.com/issues/99feb/germs.htm.

Earl, M. L.; Jackson, M. M. and Richman, L. S. (2001), Improved Rates of Compliance with Hand Antisepsis. Guidelines; *American Journal of Nursing;* Mar. 2001; 101 (3): 26-33.

(Continued)

*Primary Examiner*—Michael Mar
*Assistant Examiner*—Melvin A. Cartagena

(57) ABSTRACT

Described are methods and apparatus for promoting and attaining effective hand hygiene based on the employment of a class of packaging which provides timely access to and convenient use of hand sanitizing fluids for hand rubbing. A specific and novel type of package representative of this class found to be particularly useful in facilitating this method is a small, flat, disposable, twin chambered, multi-dose, self-sealing polymer packet designed to be pocket carried by the user. Through simple and direct finger manipulation a measured dose of hand sanitizing fluid is drawn on to the hand in a controlled and wasteless manner from a metering chamber opened for dispersal through a tear in the packet wall. The self-sealing packet reserves and preserves the remaining fluid for future uses and permits the packet to be immediately returned to a pocket without any closure manipulation. Rubbing the hands to distribute the fluid achieves an effective degree of hand sanitation by substantially reducing the presence of hand-borne pathogens. Distribution of the packets is encouraged by the use of lottery and gaming techniques that heighten the opportunity of using a hand sanitizing fluid for proper hand hygiene.

25 Claims, 3 Drawing Sheets

OTHER PUBLICATIONS

Pittet, D. (2002), Promotion of Hand Hygiene: Magic, Hype, or Scientific Challenge?; *Infection Control and Hospital Epidemiology;* Mar. 2002; 23(3).

Boyce, J. M. (2000), Using Alcohol for Hand Antisepsis—Dispelling Old Myths; *Infection Control and Hospital Epidemiology,* Jul. 2000, 21(7).

Boyce, J. M. (2001) Antiseptic Technology: Access, Affordability, and Acceptance; *Emerging Infectious Diseases;* Mar.-Apr. 2001; 7(2): 231-233.

Dyer, D. L.; Shinder, A.; Shinder, F. (2000), Alcohol-free Instant Hand Sanitizer Reduces Elementary School Illness Absenteeism; *Family Medicine;* Oct. 2000; 32(9): 633-8.

* cited by examiner

HAND SANITIZING PACKET AND METHODS

FIELD OF THE INVENTION

The present invention relates to hand sanitation apparatus and methods making the dispensing of a hand sanitizing fluid both timely and convenient. More particularly the present invention relates to the easy use features of small disposable multidose packets inconspicuously carried by a user and methods promoting their at hand availability which contribute to their timely use in reduce hand-borne pathogens.

BACKGROUND OF THE INVENTION

It is well understood that microbiological pathogens on the hands transferred to other body parts such as the mouth, nose and eyes are the primary cause of infectious disease in humans. The actual scope of the damage caused by infections resulting from hand-borne pathogens is generally less known. Fully eighty percent of all infections ranging from the usually benign cold and more debilitating flu to the truly horrific deadly Ebola, and everything in between, are transmitted by touch. The average American will contract two to four cold or flu infections in a typical year, experience four to six significant gastrointestinal disruptions during the same period. Colds alone account for an annual loss of 300 million person days of work and school annually; flus cost Americans $10 billion a year in lost wages and medical expenditures in addition to the 20,000 to 50,000 deaths each year from complications of influenza infections. Additionally, over and above the readily recognized cause and effect of the rapid onset of miseries characterized by the likes of a Norwalk virus attack, there is a growing body of evidence and in some cases solid proof that many major chronic diseases like gastric ulcers, stomach cancer, heart disease, cervical cancer, ALS (Lou Gehrig's disease), and Alzheimer's, most characterized by a much delayed onset, are infectious germ-based diseases that follow the same hand-based route into the body as the common cold rhinovirus. The scope of this generally unrecognized hidden plague associated with infectious diseases has been discussed for years within the medical community and more recently has found its way into the popular press, *Atlantic Monthly*, February 1999, ("*A New Germ Theory*"). It is sobering to realize the risk of a hand-borne infection is not just the occasional case of the sniffles but possibly the source of a life-long debilitating disease, a crippling condition leading to an early death, or most terrible, a tragic living death that strangles all hope and affection. For years the famed Mayo Clinic has used the following blunt slogan in an attempt to drive home a point about the need for effective hand hygiene to combat serious diseases: "The ten worst sources of contagion are our fingers."

Each year more than 2 million hospital acquired (nosocomial) infections occur in the United States, costing some $4.5 billion in additional charges. The Centers for Disease Control estimates more than one-third of healthcare associated infections can be prevented through better infection control programs of which hand cleaning is the centerpiece for reducing the spread of infection. Hospitals are only one of many organizations burdened with hand-borne disease costs. A recent school study found that classrooms that made hand sanitizing fluid dispensers simply available for use showed a 20% reduction in student absenteeism due to illness as well as a 10% decrease in teacher absenteeism.

Several recent articles provide an understanding of the current level of technology available for hand sanitation and further describe the significant limiting problems the present art faces.

In March 2001 an *American Journal of Nursing* article ("*Impact Rate of Compliance with Hand Antisepsis . . .*") stated that 80,000 hospital deaths occur each year as a result of nosocomial infections contracted during their stays. Further, that "it's common knowledge that the hands of heath care workers can carry disease-causing organisms from one patient to another and that hand antisepsis before and after each patent contact is crucial to the prevention and control of nosocomial infection." The reasons most often cited by hospital staff for failing to clean their hands adequately are inconvenience and no time. Given the hectic and demanding nature of their workload these are not excuses but simply statements of reality. That convenience and time are critical factors in maintaining hand sanitation is underscored by the finding in this study that placing hand sanitizing fluid dispensers "in the hallways outside patient rooms were nearly 30 times more likely to be used than dispensers mounted anywhere inside the rooms." Yet the most disturbing finding of this study was that full compliance with hand antisepsis guidelines was an unrealistic goal. That while hand sanitizing fluids took less time than washing and the placement of numerous dispensers bottles made matters somewhat more convenient, even with the heightened attention impact of the study itself (the Hawthorne effect), compliance did not achieve more than 60% at any time during the study. And it is well understood that over time, after the study is done and gone, a drift back to much lower compliance rates is inevitable; the dispenser bottle becomes just one more thing in the room, like soap at the sink, rarely used and only when time and convenience allowed.

In March 2002 an article in *Infection Control and Hospital Epidemiology* ("*Promotion of Hand Hygiene: Magic, Hype, or Scientific Challenge?*") restates the conditions for promoting adequate hand hygiene. "Among enabling factors, engineering control must be considered for the successful promotion of hand hygiene. In particular, it involves making hand hygiene easy, convenient, and possible in a timely fashion." Another observation made is that the higher rates of compliance seen in studies can only be sustained when some form of cost-effective, non-intrusive monitoring is invented. "My personal opinion is that obtaining a sustained and never-ending Hawthorne effect associated with improved compliance with hand hygiene and decreased infection and cross-transmission rates should be the dream of every hospital epidemiologist. Let's find a cost-effective way to induce it." This need remains yet unfilled in the marketplace and published art.

In July 2000 another article in *Infection Control and Hospital Epidemiology* ("*Using Alcohol for Hand Antisepsis—Dispelling Old Myths*") the qualities and values of alcohol-based hand antiseptics are described. The author points out the cost benefits of hand sanitizing fluids in hospitals. " . . . administrators should consider that modest increase in acquisition costs for alcohol-based hand hygiene products are tiny in comparison to excess hospital costs associated with nosocomial infections. If increased use of an alcohol gel or rinse reduces the number of serious nosocomial infections by a few a year, the cost savings from prevented infections should more than offset incremental costs of using alcohol-based preparations." These offset costs are those the hospital would charge as operational costs. Not considered are the much more substantial costs of the damage awards issuing from pain and suffering lawsuits won by patient and their attorneys for the hospital's failure to follow best practice protocols.

In March 2001 an article in *Emerging Infectious Diseases* ("*Antiseptic Technology: Access, Affordability, and Acceptance*") further reinforces the findings that time and convenience are critical compliance factors. Detailed costs of implementing a hand hygiene program are also provided.

A final article in the October 2000 issue of *Family Medicine* ("*Alcohol-free Instant Hand Sanitizer Reduces Elementary School Illness Absenteeism*") reports a remarkable reduction in absenteeism when hand sanitizers were introduced in public school classrooms. Results showed students using hand sanitizing fluids "were found to have 41.9% fewer illness-related absence days, representing a 28.9% and a 49.7% drop in gastrointestinal- and respiratory-related illness, respectively. . . . Conclusion: Daily use of the instant hand sanitizer was associated with significantly lower rates of illness-related absenteeism." In this study the close monitoring and continual instruction of the test group by teachers largely abrogated the issues of time and convenience. Nevertheless, it clearly indicates the significant impact consistent and rigorous hand sanitation can have in schools and the implications for parallel benefits at all levels of society are obvious. As the reports point out in describing the interlinking cost of disease "Even if one doesn't have school-age children, it is necessary to understand the importance and benefits of good hand hygiene, not only in clinical practice but also in the greater community. Vital tax dollars will be saved on expenses for remedial student services and employee work time by this simple and effective way to decrease illness-related absenteeism."

That improved hand hygiene can be achieved by using various hand sanitizing fluids is beyond question, the problems preventing this known technique for achieving a high degree of use (compliance) are equally understood as being time required and convenience use. These same twin factors are true in the vastly greater pool of the general population, with the addition of a third very important factor—easy availability to achieve timely use, in a word, timeliness. In hospitals and schools availability is defined in terms of convenience and it has been repeatedly shown the placement of bottle dispensers in rooms, particularly by a door, leads to statistically significantly improvements in hand hygiene and related disease. It has also been shown that recidivism is immediate when compliance monitoring stops. For the general population an approach emphasizing wide distribution, ready access, convenient use, inconspicuous, omnipresence, and timely applications are key factors. The state of the art as defined by the marketplace and patent literature does not provide either methods or devices that adequately respond to these requirements. Dispensers hung on walls or set on counters have proven only marginally effective in even the controlled environments of hospitals and schools; in public their effectiveness rating falls to near zero. The answer lies in development of an inexpensive, disposable, multi-dose, small, convenient, self-sealing, ubiquitous, inconspicuous, and pocket carried packet dispenser of hand sanitizing fluid that can be accessed in a timely manner and reused several times during the course of a day's normal activities. Successful methods promoting the wide distribution of such packets would contribute to eventual habitual use.

There are only two types of pocket carried hand sanitizing fluid dispensers known to be currently offered in the marketplace. The first type is represented by a small bottle containing a 62% ethyl alcohol antimicrobial agent manufactured by Gojo Industries (http://66.181.86.144/cgi-bin/gojo/). It is a 15-milliliter translucent thermoformed bottle of hand sanitizing fluid with a snap cap closure with overall dimensions of 5×2.5×1.5 centimeters and some 18 cubic centimeters in volume. Dispersement is accomplished by popping open the snap lid, squeezing or shaking out several drops into an open hand, recapping the bottle, and returning it to a pocket. This dispenser has been in the marketplace since at least 1997. A second dispenser type that irregularly appears in the marketplace is a single-use metal foil packet containing 1.5-millilters of 60% ethyl alcohol with various herbal extracts and sometimes various emollients. Lafayette Promotional (http://216.223.163.4/products/hand_gel_packets.htm) is one of several distributors of this packet form. The foil packet typically measures 5×7.5×0.3 centimeters with a volume of about 2 cubic centimeters. Dispensing is accomplished by tearing the foil at a corner edge, pouring or squeezing out the fluid, and discarding the empty foil package. Both types of products appears to have achieved a degree of success in the marketplace as evidenced by their continued presence on the web, of the two the bottle is overwhelming more commonly found. There are literally dozens of other suppliers offering the same types of dispensers.

Why these two packaging styles have not met with more success in a potentially huge market has likely more to do with fashion, habit and convenient access than a failure of the public to appreciate the health threat poised by handborne pathogens. Many people understand and appreciate the need for clean hands but just fall far short in practice. It has proven so inconvenient to perform the frequent and necessarily timely hand rubbings that provide an effective level of protection that the habit has simply never become established in any significant population group. In the case of the bottle its size, particularly its thickness, creates such a noticeable bulge in a shirt or pants pocket that it makes a negative fashion statement only equaled by pocket protectors in high school; further, the highly visible process involved in handling the bottle during the act of dispensing definitely conveys an unfortunate phobic impression about the user. Despite the efforts of hundreds of school boards across the nation not even elementary kids could be persuaded to carry and regularly use these small bottles; it just isn't fashionable and certainly less than cool. In the case of the single-use foil packet the need to carry several, typically four to seven a day, plus the need to discard an empty packet each time, severely works against public acceptance. Further, the need for the antimicrobial material to be necessarily runny in order to be easily extracted from the opaque foil packet leads to loss of the material from the hand through accidental runoff, and increasing the viscosity leads to significant difficulty in emptying the foil packet in a expedient manner without an unfortunate degree of very unwelcome messiness. These and other shortcomings have left the only two known types of carried hand sanitizing fluid dispenser products with a somewhat limited public appeal. Based on an extensive review of commercial literature no other packaging techniques are known to be in the marketplace today nor could there be found any suggestion of a more effective alternative solution to the small bottle or the single-use foil packet approaches. There is a distinct and unmet need for a middle product, a hand sanitizing fluid dispenser that functionally fits between these current marketplace offerings. A product adequate for a full day's needs of four to seven rubbings, that is without bulk, operates in a self-sealing manner, can be accessed easily, permits discrete usage, and is sufficiently affordable to be omnipresent and disposable.

Other prior art as described in the patent literature offers few relevant disclosures and what could be found is discussed as follows. The pertinent patent art can be divided into four subject areas: Packets with Rupturable Barriers (6), Single-Use Packets (2), Tortuous Path Seals (4), and various Sealing Valves (6). There have been numerous prior art devices for dispensing liquids, but out of the entire prior art only one (Kocker U.S. Pat. No. 6,228,375) deals specifically with a disposable hand sanitizing fluid dispensing packet and an associated hand hygiene method based on the single-use packet. Kocker disclosed a packet that will be more fully described below in Single-Use Packets category. The other cited patents herein deal almost exclusively with techniques for opening, dispersing and sealing various packet configurations. As portions of the present invention use in unique configurations many of these features, in addition to a newly discovered deforming self-sealing choke valve and other original features, it is useful to review the prior art so novel differentiation and inventive fashions can be clearly delineated.

In the first group (Packets with Rupturable Barriers) there are six patents that are relevant in some fashion.

Miller U.S. Pat. No. 3,913,789 disclosed a fluid containing packet with a weakly sealed and thus breakable area in the peripheral seal which forms an opening when pressure is applied via a flexible wall to the contained fluid.

Strenger U.S. Pat. No. 4,759,472 disclosed a rupturable seal that when burst by fluid pressure flowed into a diverter area to meter out a controlled flow.

Farmer U.S. Pat. No. 4,872,556 disclosed a single portion packet with two seams that peel apart under pressure forming a discharge opening.

Lane U.S. Pat. No. 4,890,744 disclosed a single-use with one or more pressure rupturable frangible seals and controlled dispersing chamber.

Farmer U.S. Pat. No. 5,131,760 disclosed a single-use dual chamber dispenser with rupturable membranes to control the discharge of the fluid.

May U.S. Pat. No. 6,379,069 disclosed a tube dispenser with a rupturable dividing membrane with weakening folds and creases.

The present invention does not employ any rupturable membrane seals nor do any of the above disclose or suggest their usage in a hand sanitizing method. Two patents in the Single-Use group are as follows:

Kocher U.S. Pat. No. 6,228,375 disclosed a single-use, single chamber disposable packet containing a hand sanitizing fluid that is either dispersed as a spray when a seal bursts under pressure or a tear is made in the packet. A method using single-use packets for hand sanitation is claimed.

Sokolsky U.S. Pat. No. 6,360,916 disclosed a single-serving condiment pouch employing a trapezoidal shaped configuration and opening to dispense a flat ribbon of food condiment.

Neither of the two single-use packets disclose or suggest the multidose, seal-sealing valve packets, or methods using same of the present invention. Four patents in the Tortuous Path Seal group are as follows:

Kaplan U.S. Pat. No. 2,707,581 disclosed a flexible dispensing container with a tortuous passage serving as a spring check valve which allows fluid to flow when placed under pressure.

Jamison U.S. Pat. No. 4,491,245 discloses a flow channel with a serpentine configuration and a spout tear for dispersement.

Billman U.S. Pat. No. 5,018,646 disclosed a serpentine discharge configuration protected from being deformed by wall indentations of the container.

Zakensberg U.S. Pat. No. 5,839,609 disclosed a tortuous path valve of thermoformed ridges and recesses to form a positive seal for the pack.

None of the four Tortuous Path group disclosed or suggested a deforming self-sealing valve/choke of the present invention nor do they disclose or suggest any hand sanitizing method. The final group, Sealing Valves, with six patents are as follows:

Volckening U.S. Pat. No. 3,184,121 disclosed a flexible package with a discharge outlet passage of resilient material capable of self-closing following a pressure induced passage of fluid.

Brown U.S. Pat. No. 3,278,085 disclosed a liquid squeeze tube with a fold over flap seal for containing the remaining fluid following a use.

Hellstrom U.S. Pat. No. 3,635,376 disclosed a package container with a snap open/close valve of tensed flexible sheets to control flow.

Haggar U.S. Pat. No. 4,328,912 disclosed a dispensing package using a convex/concave pop valve to control a flow channel and thus regulate multiple doses.

Chan U.S. Pat. No. 5,529,224 disclosed a self-closing liquid dispensing package with a self-sealing flat channel valve that relies on pre-tensed resilience to resealing following pressure induced dispersement from a thermoformed reservoir.

Farmer U.S. Pat. No. 6,244,468 disclosed use of a spaced pair of pre-tensed transverse creasing folds as a self-sealing valve for dispersing liquid soaps by a stripping action.

None of the six Sealing Valves disclosed or suggested a deforming self-sealing choke valve of the present invention nor do they indicate any use in a hand sanitizing method. No prior art in either the literature or patents could be found which addressed the use of lottery or gaming promotion techniques associated with hand sanitizing fluid dispensers and packaging thereof.

The above discussed current practices and known forms of dispensers together with various packaging types, all were found deficient in several respects. Significantly, none of the above references taken in part or as a whole presents a convenient, timely, and effective way of facilitating the use of hand sanitizing fluids achievable by means of a small, flat, clear, disposable, twin chambered, multi-dose, self-sealing, polymer, pocket carried packet. None overcome the recognized problems of timeliness, convenience, and accessibility provided by the advancement to the art the present invention contributes.

SUMMARY OF THE INVENTION

The present invention recognizes and addresses the foregoing disadvantages and shortcomings of the prior art. Accordingly it is a primary intent of the present invention to provide a distinctly novel product concept (packet) and equally important innovative method using the packaging concept to overcome the problems of time, convenience, and timeliness which have previously curtailed the effective use of hand sanitizing fluids by the general population. Further, a method is disclosed whereby distribution of packets is encouraged by the use of lottery and gaming techniques which heighten the opportunity of using a hand sanitizing fluid for hand hygiene simply because the packet was obtained and retained at hand in hopes of it being a winner.

And hence the AtHand™ brand name and trademark identifying both the packet packaging and associated methods. A key element in making such a multi-dose packet a reality was the discovery that a simple arrangements of design components could constitute a seal-forming choke valve and an associated weakly adhesive film valve made from existing packet materials could retain and preserve highly volatile hand sanitizing fluids over a day's time despite many openings for usage. All hand sanitizing fluids have one important attribute in addition to killing pathogens, they evaporate very quickly from the hands. Understandable enough given they are typically some two-thirds alcohol. In less than a minute, usually under thirty seconds, the hands are dry, the liquid evaporated and gone. How could a cheap, simple packet retain such a vaporous fluid over hours or even days after being opened? Bottles used for such purposes have substantial caps, tight seals, and thick walled bodies to preserve their fluids, how could a necessarily cheap, flimsy packet accomplish such protection once opened? By trial and error investigation, pursued following a chance observation that a film of regent grade alcohol trapped between two loose sheets of plastic film did not evaporate quickly, it was discovered that a packet could be created that employed a dispensing means that so limited evaporation the loss became inconsequential even over days of time. Later discovery of the deforming choke valve provided a necessary element of overall robustness to the fluid control. These discoveries held up even in the rough handling commonly found in pants pockets, even at the elevated temperatures generated by body heat. This discovery that highly volatile hand sanitizing fluids could be packaged in a new and novel manner opened the door to the present invention.

A primary object of the present invention is to provide a novel and significant advancement in the art of hand sanitizing dispensing apparatus in the form of a packet which overcomes the problems of time, convenience, and timeliness by being small, flat, multi-dose, self-sealing, inconspicuous, clean dispensing and pocket carried.

Another object of the present invention is a method promoting and attaining hand sanitation by using carried multi-dose packets of hand sanitizing fluid to reduce hand-borne pathogens and subsequently lower the rate of infectious diseases in the general population.

Another object of the present invention is a method to encourage the distribution and retention of hand sanitizing fluid packets through use of lottery and gaming techniques that heighten the opportunity the packets will be available for use in a timely act of hand hygiene maintenance.

Another object of the present invention is the use of transparent material for the packet body to assist in fluid manipulation, dose measurement, color based selection, quantity/quality determination, and other visually based judgements and actions made possible by a clear body packet material.

Yet another object of the present invention is to provide a very simple but effective engineered valve or choke arrangement to govern the passage of fluid within the packet and act as a self-sealing closure to retain and preserve remaining fluid for future dispersement.

A final object of the present invention is the use of a packet stripping chamber that deploys a measured dose of hand sanitizing fluid directly into a cupped hand and finger arrangement that substantially eliminate mess and waste while significantly improving convenient usage.

Other objects and advantages of the present invention will become apparent from the following description taken in conjunction where appropriate with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DETAILED DESCRIPTION OF THE INVENTION

Figure 1:
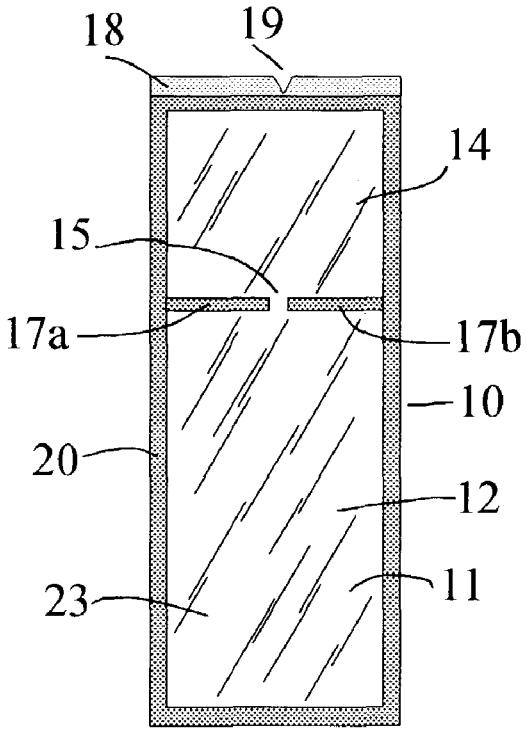
FIG. 1 is a frontal view of the preferred embodiment of the dual chamber packet, with the dividing barrier a defining a gap passage that allows fluidic communication between the two chambers, in accordance with the principles of the present invention.

While the invention will be described in connect with illustrations, descriptions, and examples of preferred embodiments, it will be understood these are not intended to limit the present invention only to these embodiments. On the contrary, the present invention is to cover all structural and/or functional alternatives as defined by the appended claims.

The term "hand sanitizing fluid" as used herein refers to any non-irritating, antimicrobial-containing composition in the form of a fluid, gel, spray, foam, cream, lotion, or tincture preparation designed for frequent use that can reduce the number of transient microorganisms, specifically pathogens, when applied to and dispersed over the hands and other skin areas. Such preparations have a broad antimicrobial spectrum, are fast-acting, and are often persistent. Representative of such agents are alcohols (e.g. ethyl and isopropyl), iodines (e.g. hexachlorophene), bisbiquanides (e.g. Chlorhexidine digluconate), and quaternary ammonium salts (e.g. Benzalkonium chloride) which are formulated singularly or in combination. This term is specifically intended to include all such preparations, known and unknown, that are capable of achieving a substantial reduction of skin resident pathogens when applied to the hands or other areas of human skin where such pathogens are found.

The term "flexible polymeric material" as used herein refers to any polymer film capable of being constructed into a packet for containment and preservation of a hand sanitizing fluid. Such polymer films as may prove useful for this purpose have sufficient flexibility to yield to finger pressure, are sufficiently durable to withstand reasonable hydraulic pressure created by fingers, have good crack and puncture resistance, have very good chemical resistance and low gas permeability, and are capable of being sealed to self or other materials. Representative of such films are polypropylene and polyethylene. Numerous grades, gauges, textures, combined in many lamination varieties, formed by many techniques, with numerous additives, and an even greater numbers of formulations provide a wide array of polymeric materials to select from, singularly or in combination, to satisfy the specific chemical, physical, and aesthetic attributes required for a specific packet's construction, its content's formulation, and the precise function for which it is intended. All known and yet unknown polymer materials functionally suited for use in constructing multi-dose packets containing hand sanitizing fluids are envisioned by use of this term.

The present invention is best understood by several examples that illustrates and describes how various aspects of each apparatus and method functions. Example 1 details the hand sanitizing fluid packet by means of illustrations (FIGS. 1–8) and operational descriptions. Example 2 describes a method using hand sanitizing fluid packets to achieve and maintain an effective level of personal hand hygiene. Example 3 describes a method encouraging the distribution and retention of hand sanitizing fluid packets for hand sanitation by keeping them handy by various lottery and gaming techniques.

EXAMPLE 1

Multi-dose Hand Sanitizing Fluid Packet

Figure 2:
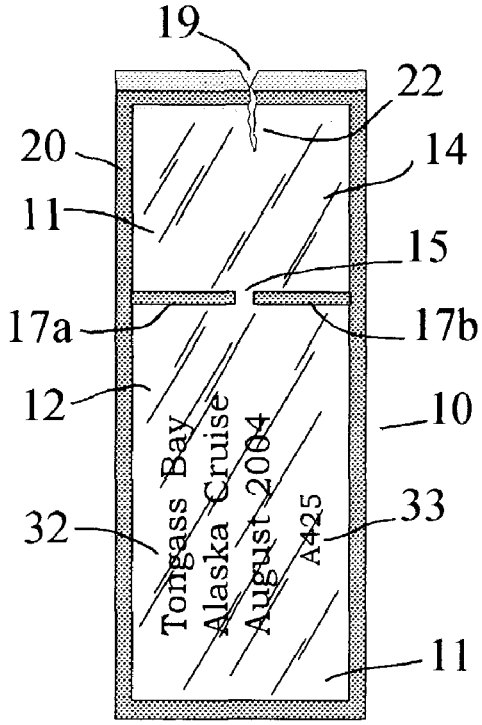
FIG. 2 is a frontal view with examples of various markings on the body of the packet.
Figure 5:
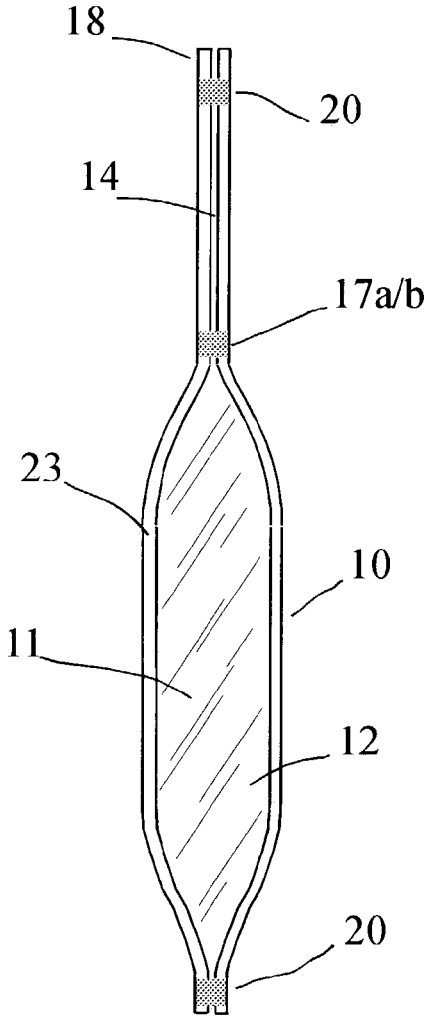
FIGS. 5 and 6 are cross-sectional views showing first and second chambers at rest (5) and pressure applied to first chamber causing movement of fluid into second chamber for dispensing (6).
Figure 6:
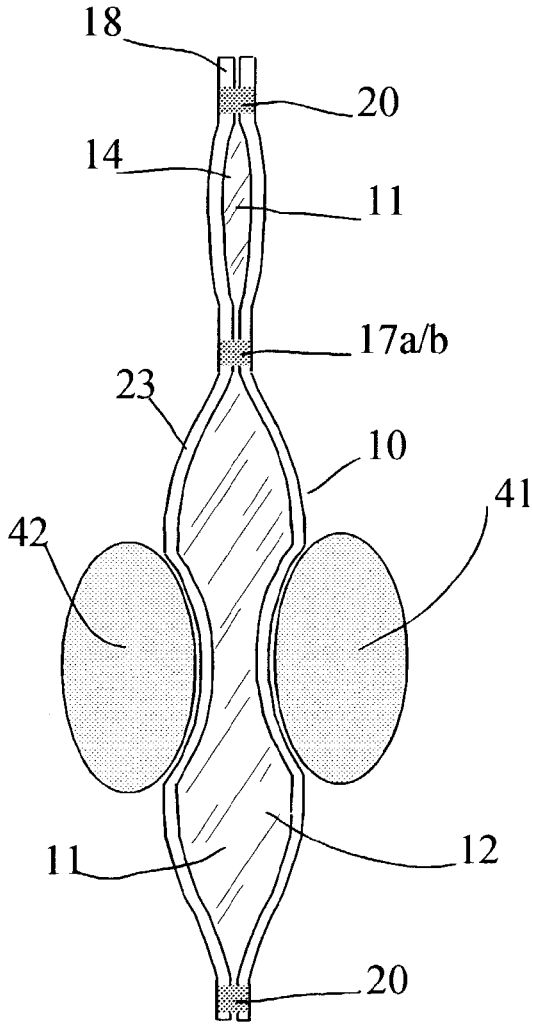

The preferred embodiment of the packet generally designated by the reference number 10 of FIGS. 1 and 2 has a peripheral seal 20 joining front and back walls 23 of flexible polymeric material (2-mil polypropylene) to enclose and contain a hand sanitizing fluid 11 (Purell Hand Sanitizer, 62% alcohol) with two chambers, a first chamber 12 and a second chamber 14. Overall dimensions in this packet embodiment are 9×3×0.5 centimeters with first chamber 6-centimeters long and second chamber 2.5-centimeters long and the balance of the length in sealed edges 20 and margins 18. Creating and dividing these adjacent chambers is a partitioning means in the form of a two-part barrier 17*a* and 17*b* created by sealing the front and back walls 23 in a like manner used to create the peripheral seal 20. Creation of the seals can be achieved by a number of means well known in the art, herein the common technique involving heat and pressure are used to create the seals. The two distinct chambers, 12 and 14, are in fluidic communication in that the contained fluid 11 can be transferred between the two chambers, 12 and 14, by a relatively small constrictive gap (about 1-millimeter or less) 15 in the thin barrier seal (about 1-millimeter wide) 17*a*/*b*. This inter-chamber fluidic transfer is made possible by appropriate placed stresses such as pressure applied to the pocket walls 23 of flexible polymeric material by fingers. In FIGS. 5 and 6 the filled reservoir of the first chamber 12 is shown in a cross section view, FIG. 6 shows fingers 41 and 42 applying pressure and filling second chamber 14 with fluid 11.

Typically, the first chamber 12 acts as a reservoir of hand sanitizing fluid (typically 3-millimeters, but ranging 2–8 millimeters) that constitutes plural doses of fluid 11 to be dispersed over perhaps a day's time. By applying pressure to the first chamber 12, fluid 11 is pushed through the barrier gap 15 into the second chamber 14. The amount of fluid 11 transferred from the first 12 to second chamber 11 is easily controlled by the amount of pressure applied and gauged by eye given the transparency of at least part of one wall 23 of the packet 10. When a predetermined amount of fluid 11 has been transferred, typically 1–2 milliliters, into the second chamber 14, a tear 22 is created by fingers in the second chamber 14 walls 23 starting at a manufactured notch 19 in the margin 18 beyond the peripheral seal 20 at the top of the second chamber 14. This tear 22 forms the dispersal exit for the measured dose of fluid 11 from the second chamber 14. Dispersal is accomplished by holding the packet by the fingers of one hand in the area of the first chamber 12, placing thumb and forefinger of the other hand on opposite walls 23 of the second chamber 14 at the barrier seal 17*a*/*b*, and stripping the second chamber's 14 measured dose of fluid 11 toward and out of the exit tear 22 into the cupped hand created by the finger arrangement. The second chamber 14 has performed the role of first holding the measured fluid 11 transfer from the reservoir first chamber 12 and then acted as a dispensing structures that cleanly, accurately, and with little or no waste deposited the dose into a hand for rubbing and reduction of hand-borne pathogens. A third role for the second chamber 14 is now begun; the interior surfaces of the second chamber's 14 wall 23 still retain a thin film of fluid 11. This thin residue weakly holds the walls 23 together, partially by adhesion and somewhat by the dynamics that govern fluidic films. By holding the walls 23 together a minute surface area is exposed to evaporation in the area of the tear 22, consequently there is little lose of fluid 11 at the film/atmosphere interface and it slows even more as the interface edge surface does retreat between the walls to a point where the retreat stops, a point where the atmospheric boundary becomes so saturated with evaporated fluid 11 and lack of atmospheric circulation that for all purposes a seal is formed preventing further loss. The second chamber 14 has become a dispensing valve means, a form of film seal, specifically designed to control loss of fluid 11 from the packet 10 by retarding evaporation and leakage.

Figure 3:
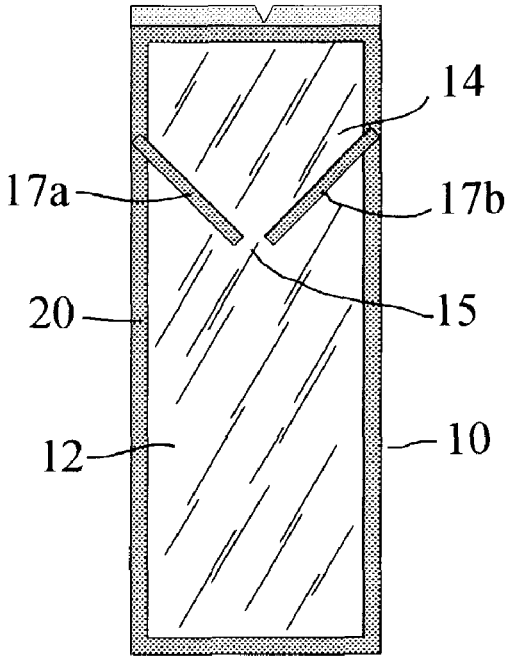
FIGS. 3 and 4 are views where the dividing barrier elements are at an angle (3) or offset at an angle (4).
Figure 4:
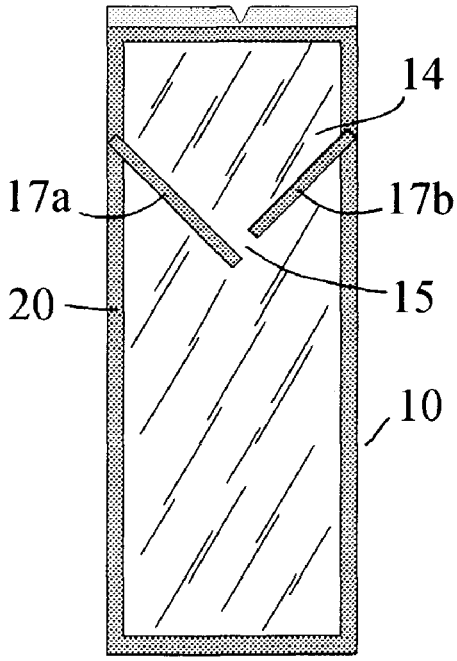

This dispensing valve works in conjunction with a second fluid control means created by the barrier 17*a*/*b* and the gap 15 therein. The barrier 17*a*/*b* and gap 15 structures illustrated in FIGS. 3 and 4 show alternatives positions of the two-part barrier 17*a* and 17*b*. In FIG. 3 the barrier parts 17*a*/*b* are placed so as to form a conjunctive angle to one another as they bear on forming the gap 15. This is in contrast to the aligned relationship of the barrier 17*a*/*b* shown in FIGS. 1 and 2. In FIG. 4 the barrier 17*a*/*b* shows as offset, asymmetrical position of the gap 15. All these barrier gap 15 positions and barrier 17*a*/*b* alignments produced comparable results.

In FIG. 2 marks 32 and 33 on the body of the packet 10 are shown as printing on the exterior surface of a packet 10 wall 23. Such marks can denote a wide range of meanings and values, including such useful communications as addresses, advertising messages, call numbers, codes, company names, event commemorations, event dates, decorative art, facility names, formulas, fortune predictions, gaming symbols, instructions, internet addresses, logos, lottery numbers, lottery symbols, meaningful images, notations, promotional slogans, raffle numbers, schedules, trademarks, and other meaningful communications. In this example "Tongass Bay Alaska Cruise August 2004" commemorates a cruise ship's visit to a remote locale. Making one wall 23 or a portion of the packet 10 opaque facilitates the reading or deciphering of any marking placed on the packet 10.

Figure 7:
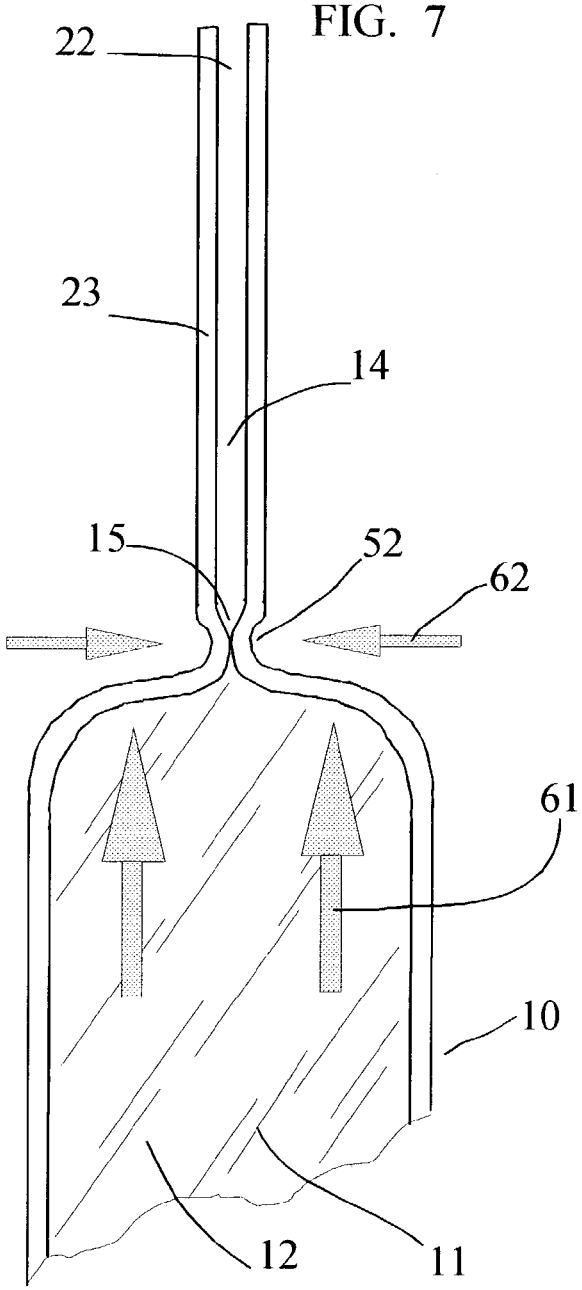
FIGS. 7 and 8 are cross-sectional views showing the first chamber pressure the closing choke valve by deforming the passage (7) and opening choke valve by applying a tension pull at second chamber which opens the choke valve allowing fluid to pass into second chamber (8).
Figure 8:
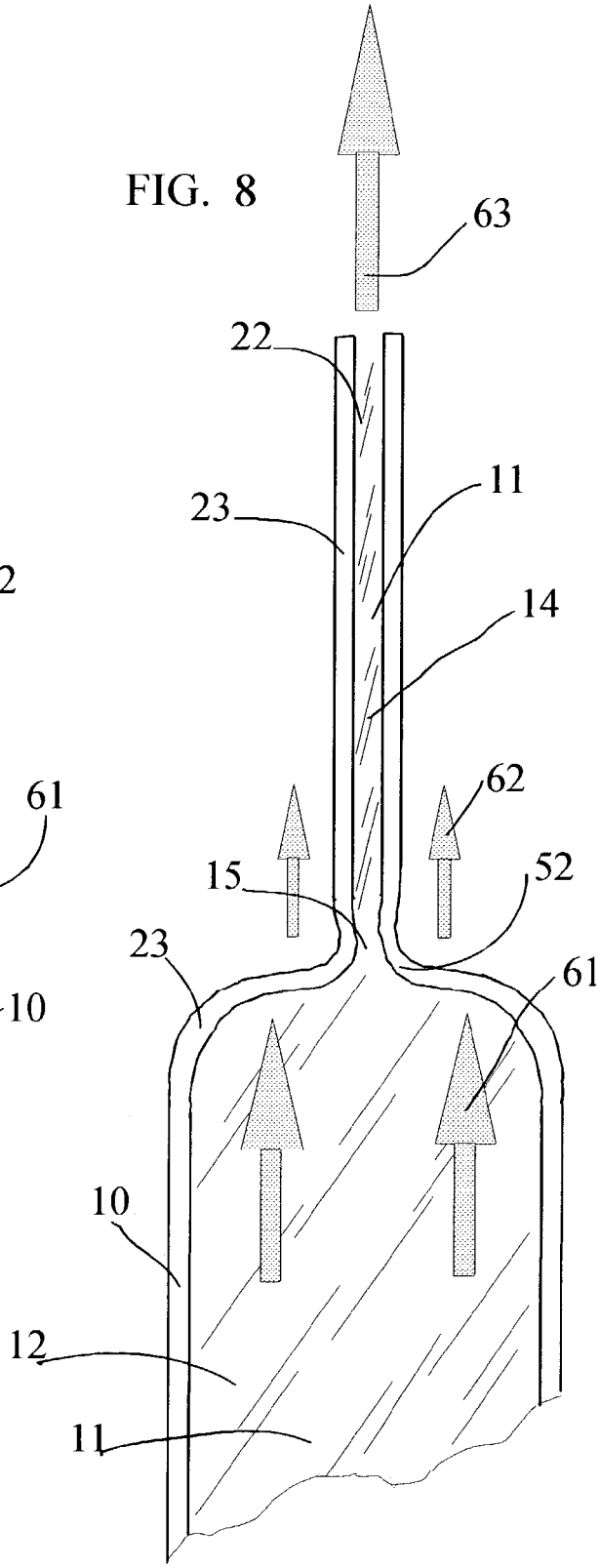

The gap 15 forms a fluid passage governing means that can, when actuated by fluidic pressure originating from either chamber, stops fluidic communication between the chamber up to a moderate level of such pressure. This governing means takes the form of a self-forming choke that stops low level pressure pushing fluid 11 into the second chamber 14 and destroying the weak film seal which could lead to substantial leakage and loss of fluid 11 after an initial usage. Under even slight pressure the gap's 15 design created by it small width defined by the two barrier 17*a*/*b* ends resists fluid movement and builds pressure on the flexible walls surrounding the gap 15 area. In FIG. 7 this reservoir pressure 61 distorts the packet walls 23 in the gap 15 and closes the opening 52 by lateral pressure 62 deforming in a crimping fashion the flexible nature of the polymeric material used to form the walls 23 of the packet. A choke valve 52 self-formed by pressure capable of moving the fluid 11 through the choke area, the gap 15, restricts that same flow. This restriction is sufficient to control unintended discharges from the first chamber 12 into the second chamber 14 and out through the exit tear 22 that would create unexpected leakage and similar undesirable discharges. The choke can be opened in two ways to allow fluid passage into the second chamber 14 when intended and desirable. Simply by continuing to increase the pressure applied to the walls 23, it will eventually become possible to overcome the self-formed choke and fluid 11 will squirt into the second chamber 14. The pressure required can be significantly high and possibly beyond the strength of some users. A second and easier method of opening the choke 52 is shown in FIG. 8 where tension 63 applied to the notched 19 end of the second chamber 14. By pulling on the packet 10 end where the tear 22 is located, while holding and applying pressure to the first chamber 12 reservoir of fluid 11, the deformed gap 15 area of the choke 52 is straightened out 62 sufficient to allow the fluid 11 to pass into the second chamber 14 for eventual discharge through the tear 22 exit. The release of pressure or it dropping below a certain level either removes the self-forming choke 52 or allows the choke 52 to reform, in either case fluid 11 flow is once again restricted.

Transparent walls 23 of the packet permit a number of novel advances in the art of hand sanitizing fluid dispensers. With clear walls 23 it becomes possible to visually inspect the quantity and location of the fluid 11 in the first 12 and second 14 chambers so proper manipulation is possible. The same clear walls 23 facilitate stripping the fluid for dispersement. Visual inspection for the quality of the fluid 11 is also made possible. Packet selection made by sight based on the color of the fluid 11 is now also possible, as can the same opportunity for choice selection based on fluid 11 color indicating the inclusion of specific additives or formulation with specific antimicrobial properties. Clear walls 23 also permit inspection to determine the degree of completeness when kneading the fluid 11 is necessary to mix separated ingredients.

It should be noted that by design, materials are called upon to perform many different role, thus packaging is kept to a minimal amount to reduce ecological impacts, lower costs, and contribute to the packet's small size. Fluid waste is also negligible by virtue that every drop can be effectively stripped from the packet 10. Small bottles consume many times the packet's 10 packaging resources and are notoriously wasteful of the fluid left trapped inside. The packet 10 permits full extraction of hand sanitizing fluid 11 leading to a greater economy of usage.

EXAMPLE 2

Hand Sanitation Method

A disposable multi-dose packet of hand sanitizing fluid with self-sealing features that is unobtrusively carried in an easily accessible pocket would greatly contribute to the timely need to sanitize hands several times a day. Convenience of use and access are key features. For example, follow this narrative of a typical use that illustrates the promotion and subsequent attainment of effective hand sanitation. A father takes his daughter to a fast-food restaurant for lunch while out shopping. He places their order at the counter, pays, receives change, and their food tray. They find a booth and sit down. Before digging in, the father quickly retrieves from his shirt pocket a hand sanitizing fluid packet he had opened earlier in the morning after handling many items at a popular flea market. He offers the packet end to his daughter who reaches out and strips a dose of hand sanitizing fluid into her cupped hand and rubs. He does the same and drops the packet back into his packet without further ado. They now enjoy their lunch with a sense of well being, knowing the risk of hand-borne pathogens has been addressed.

This scenario is useful for purposes other than a functional illustration. The father may have bought the packet for his own and his family's health benefit, or he may have obtained the packet at a mall as a promotional item when he bought a book, conducted a bank transaction, or picked up a prescription at his the health clinic. Or perhaps it was leftover from a recent air flight or vacation aboard a cruise ship. It might have been bought or distributed in a number of circumstances including air travel, assemblages, barrooms, business dealings, checkout counters, conventions, cruise ships, disaster relief, educational facilities, elder care facilities, expeditions, financial institutions, food services, ground transportation, health clinics, hospitals, livestock events, lodgings, malls, manufacturing facilities, meetings, military installations, offices, parties, political gatherings, potlucks, prisons, promotional events, public events, public facilities, religious services, rest homes, schools, service counters, shops, sporting events, theaters, toilet facilities, zoos and other situations. Whatever its origin, the wide distribution has contributed to its use this day, at this table, for their health benefit.

Various modes of carrying the packet are also useful in promoting and attaining hand sanitation. By placing hand sanitizing fluid packets in carrying devices other than pockets, the opportunities for a timely reminder and access are improved. Placing a hand sanitizing fluid packet in a backpack, belt pack, briefcase, computer case, garment, lanyard attachment, lunchbox, lunch bag, notebook, purse, pocket, sports bag, tool box, telephone carrier, wrist band increases the probability of use.

Perhaps the narrative of the father and daughter at lunch would be more telling if instead of the father offering the packet to the daughter, the child offered a packet to the father. She picked up the habit in school and was now sharing it, with justifiable pride, with her father.

EXAMPLE 3

Lottery and Gaming Promotion Method

Habit formation is initially based on repetitive action and a key element in making that repetitive action possible is available circumstances. For example, the habit of using a fork to eat is not likely to develop if a fork is missing when food is served. The same is true in developing the habit of using hand sanitizing fluid packets to regularly sanitizing hands, the packets must be available at all times to form the habit of cleaning hands. Any and all techniques useful to distributing and having the user retain a hand sanitizing fluid packet is a major step toward developing a use habit simply because the packet is available in an opportune and timely manner.

One technique for promoting hand sanitation is to introduce lottery and gaining aspects so as to encourage the distribution and retention of hand sanitizing fluid packets. In the following scenario a lottery encourages and supports a significant health objective. A cruise ship's company is concerned about an outbreak of the nasty gastrointestinal Norwalk flu; two other ships in the fleet have had so many cases whole trips have been cancelled to decontaminate the vessels. The owners, officers, and crew can ill afford the staggering losses an outbreak would cause; passengers are understandable nervous about getting sick during a long planned vacation. The ship's officers and crew have done and continue to do everything possible to keep the facilities germ-free, but they know the problem does not lie with the ship. It is with the passengers that harbor the virus. When they came aboard from around the world, they bring with them a veritable menagerie of germs gathered from home and along the way. When they take day trips ashore during the cruise they bring new ones aboard from these ports of call that have become literally crossroads of world travel. To combat these continual infectious assaults the ship has introduced hand sanitizing fluid packets, and to encourage their distribution and retention has hit upon a dining lottery. At each meal a hand sanitizing fluid packet is passed out or placed with the table setting. Each packet bears a lottery number 23 as shown in FIG. 2 along with the ship's name and company logo. The winning numbers will be posted in the ship's paper the following day for prizes of caps, shirts, and other items and services available on board. Every passengers will acquire, retain and hopefully use the packet when the benefits of use are properly and repeatedly explained. Making the packets so widely available through the lottery, and stressing the fact that everyone is in the same boat so to speak regarding public health, a significant reduction of hand-borne disease is a likely outcome.

Whether the motivation for acquiring the packet is to have a chance at a lottery prize and then used for hand sanitation, or acquired the packet for hand sanitation and kept them for a possible prize, the end results of distribution and retention are achieved. Gaming can also achieve the same purpose. At lunch a group of men gather to open their lunch bags and socialize. Included in the bags are hand sanitizing fluid packets with a poker hand displayed as markings, each one different based on the statistical spread of winning hands inherent to the game. The men engage in calling out real and fictional holdings to determine who buys the cold soft drinks or the like. The packets are also used to clean the hands in that they are literally already at hand. Endless gaming options are possible based on this simple technique, and all of which encourage and promote the distribution of hand sanitizing fluid packets which can lead to usage. Good public and private health habits are in our own hands.

Throughout this specification various publications are referenced. The disclosures of these publications in their entireties are hereby incorporated by reference in order to more fully describe the state of the art to which the invention pertains. What has been illustrated and described herein is an improvement in certain types of squeezable articles of manufacture representative of fluid containers made of flexible polymeric material, specifically for dispensing hand sanitizing fluid for hand hygiene. Additionally, novel methods for employment and distribution of such article types have been described and illustrated by way of functional examples. While these improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical or functional equivalent, and other modifications will become apparent to those skilled in the art upon reading the foregoing description. Accordingly, such alternatives, changes, and modifications are to be considered as forming a part of the present invention insofar as they fall within the spirit and scope of the appended claims.

What is claimed is:

1. A disposable squeeze packet for dispensing multiple doses of hand sanitizing fluid, comprising:

a packet designed to hold and preserve hand sanitizing fluid with the general form of a substantially flat sealed pouch made of flexible polymeric material with at least two distinct chambers in fluidic communication permitting inter-chamber fluid transfer when appropriate stresses are applied via the packet walls of said flexible polymeric material;

a first chamber capable of holding plural doses of said fluid;

a second chamber capable of receiving a measured dose of said fluid from said first chamber;

a partitioning means constructed of a flexible polymeric material separating adjacent first and second chambers, said partitioning means having a fluid passage governing means formed at a passage gap in said partitioning means, wherein, when external pressure is applied to the walls of said first chamber, said fluid pressure is directed against said partitioning means adjacent said passage gap causing deformation of said flexible polymeric material to provide a self-forming choke by constricting said fluid passage formed by said passage gap, thereby resisting and blocking fluid flow between said first and second chambers; and said second chamber functioning as a dispensing valve means for said fluid held within when said fluid is pressure stripped from said second chamber through an exit means capable of being created in at least one wall of said second chamber to dispense said fluid.

2. The packet of claim 1, further comprising a fluid product enclosed within said packet, wherein said flexible polymeric material is sufficiently transparent to see said fluid.

3. The packet of claim 2 wherein the transparent said flexible polymeric material permits visual inspection of the quantity or location of said fluid in the said first and second chambers.

4. The packet of claim 2 wherein the transparent said flexible polymeric material permits measurement, manipulation, and transfer of a dose of said fluid between said first and second chambers.

5. The packet of claim 2 wherein the transparent said flexible polymeric material facilitates visual inspection for effective pressure stripping of said fluid from said second chamber for proper dispensing.

6. The packet of claim 2 wherein said self-forming choke provided by said partitioning means having said fluid passage governing means effectively prevents fluidic communication in either direction between said first and second chambers when moderate fluidic pressure is applied to either of the two chambers.

7. The packet of claim 2 wherein the transparent flexible material permits packet selection by visual means based on a choice of differently colored said fluids.

8. The packet of claim 7 wherein a specific fluid color indicates the presence of specific additives in said fluid.

9. The packet of claim 7 wherein a specific fluid color indicates a class of hand sanitizing fluid formulation with specific antimicrobial properties.

10. The packet of claim 2 wherein the transparent flexible material facilitates visual inspection of the degree of completeness of a kneaded mixing of separated ingredients of said fluid.

11. The packet of claim 1 wherein said measured dose is typically 1 to 2-milliliters of said fluid.

12. The packet of claim 1 wherein said plural doses is typically 2 to 8-milliliters of said fluid.

13. The packet of claim 1 wherein said partitioning means is a relatively thin sealed seam barrier created by joining front and back walls of the packet and said partitioning means contains a single constricting passage gap in said seam barrier for said fluidic communication between said first and second chambers.

14. The packet of claim 13 wherein both parts of said seam barrier are aligned in the area of said gap.

15. The packet of claim 13 wherein both parts of said seam barrier are at an angle to one another in the area of said gap.

16. The packet of claim 1, wherein the deformed gap acting as said self-forming choke sealing off said channel passage can be substantially undeformed by applying a pulling tension to said second chamber away from said first chamber, thereby opening said choke seal and permitting said fluid flow from said first to said second chamber.

17. The packet of claim 1, wherein the deformed gap acting as said self-forming choke sealing off said channel passage functionally fails in the presence of substantial increasing fluidic pressure emanating from said first chamber and allows passage of said fluid until said pressure drops sufficiently to allow functional restoration of said deformed gap, whereupon said self-forming choke reforms and closes off said fluid flow.

18. The packet of claim 1 wherein said exit means is a user created tear.

19. The packet of claim 18 wherein said tear is begun at a manufactured notch or cut made in the margin of said packet beyond the peripheral sealing seam.

20. The packet of claim 1 wherein said fluid in said second chamber is stripped by finger and thumb opposing pressure from said partitioning means area towards said exit means and out of said packet via said exit means.

21. The packet of claim 20 wherein said stripping action deposits said fluid into a cupped hand substantially preventing said fluid wastage through runoff or dropping before rubbing distribution.

22. The packet of claim 1 wherein said inter-chamber fluid transfer and said stripping action substantially empties all of said fluid from said packet over several uses and consequently significantly reduces packaging wastage by design of said packet which leads to a greater economy of use of said fluid.

23. The packet of claim 1 wherein said dispensing valve means formed following said fluid stripping is an empty collapsed chamber that substantially retards evaporation and leakage of said fluid from said packet by a weak adhesive tension formed by said walls and a film of remaining said fluid.

24. The packet of claim 1 wherein said packet bears a marking wherein said marking is selected from a group consisting of addresses, advertising messages, call numbers, codes, company names, event commemorations, event dates, decorative art, facility names, formulas, fortune predictions, gaming symbols, instructions, internet addresses, logos, lottery numbers, lottery symbols, other meaningful communications, meaningful images, notations, promotional slogans, raffle numbers, schedules, trademarks, and combinations thereof.

25. The packet of claim 1 wherein at least one surface of said flexible polymeric material is opaque to facilitate reading or deciphering of markings on said packet.

* * * * *